US005784905A

United States Patent [19]

Townsend et al.

[11] Patent Number: 5,784,905

[45] Date of Patent: Jul. 28, 1998

[54] LIQUID CARBON DIOXIDE CLEANING SYSTEM EMPLOYING A STATIC DISSIPATING FLUID

[75] Inventors: Carl W. Townsend, Los Angeles; Sidney C. Chao, Manhattan Beach; Edna M. Purer, Los Angeles, all of Calif.

[73] Assignee: Hughes Electronics, Los Angeles, Calif.

[21] Appl. No.: 753,853

[22] Filed: Dec. 3, 1996

[51] Int. Cl.[6] ..... D06F 43/02

[52] U.S. Cl. ..... 68/13 R; 68/18 C

[58] Field of Search ..... 68/13 R, 18 R, 68/18 F, 18 C, 3 SS, 5 C, 140; 134/184

[56] References Cited

U.S. PATENT DOCUMENTS

| | | | |
|---|---|---|---|
| 3,101,240 | 8/1963 | Mathews | 68/13 R |
| 3,712,085 | 1/1973 | Guberman et al. | 68/18 C |
| 5,056,174 | 10/1991 | Hagiwara | 8/159 |
| 5,279,615 | 1/1994 | Mitchell et al. | 8/142 |
| 5,412,958 | 5/1995 | Iliff et al. | 68/5 C |
| 5,467,492 | 11/1995 | Chao et al. | 8/159 |
| 5,651,276 | 7/1997 | Purer et al. | 68/5 C |
| 5,669,251 | 9/1997 | Townsend et al. | 68/58 |

FOREIGN PATENT DOCUMENTS

WO 96/27704 9/1996 WIPO .

*Primary Examiner*—Amy B. Vanatta

*Attorney, Agent, or Firm*—Leonard A. Alkov; William C. Schubert; Glenn H. Lenzen, Jr.

[57] ABSTRACT

An improved liquid carbon dioxide dry cleaning system containing an improved dry cleaning fluid. The dry cleaning fluid contains an antistatic agent for dissipating static charge on members or garments generated by friction during cleaning thereof. The concentration of the antistatic agent is typically less than 1 percent. Static charge present on the members or garments that are cleaned is transferred through the dry cleaning fluid to ground. This transfer of charge minimizes static charge buildup on the members or garments and suspended soil redeposition onto the members or garments. An odorizing agent or fragrance, and/or a deodorizing agent may be added to the cleaning fluid.

10 Claims, 1 Drawing Sheet

LIQUID CARBON DIOXIDE CLEANING SYSTEM EMPLOYING A STATIC DISSIPATING FLUID

BACKGROUND

The present invention is related generally to a dry cleaning systems for cleaning garments or fabrics, and more particularly, to a liquid carbon dioxide dry cleaning system that employs a static dissipating fluid and optional deodorant.

All conventionally used dry cleaning solvents present health and safety risks and are environmentally detrimental. For example, perchloroethylene is a suspected carcinogen, while petroleum based solvents are flammable and produce smog. The assignee of the present invention has developed liquid carbon dioxide dry cleaning systems that minimize the health and safety risks of conventional dry cleaning systems and solvents.

A typical liquid carbon dioxide dry cleaning system comprises a walled vessel for containing liquid carbon dioxide to withstand pressures adequate to maintain carbon dioxide in liquid state, at typical ambient process temperatures of about 0° to 30° C., and at typical process pressures of about 500 to 1,000 pounds per square inch. A reservoir is provided for supplying liquid carbon dioxide to the walled vessel. A valve is used to optionally introduce a surfactant or co-solvent (such as water) into the walled vessel. A perforated basket having a lid is disposed within the walled vessel that holds the fabrics and garments that are to be cleaned. Apparatus is also provided for directly agitating the liquid carbon dioxide in the walled vessel to agitate the garments and fabrics in the perforated drum. Temperature and pressure controllers are provided for controlling the temperature and pressure of the liquid carbon dioxide within the vessel. Such a liquid carbon dioxide dry cleaning system is disclosed in U.S. Pat. No. 5,467,492 issued Nov. 21, 1995 and assigned to the assignee of the present invention.

Liquid carbon dioxide is an inexpensive and unlimited natural resource, that is non-toxic, nonflammable, and does not produce smog, or deplete the ozone layer. It does not damage fabrics or dissolve common dyes, and exhibits solvating properties typical of hydrocarbon solvents. Its properties make it a good dry cleaning medium for fabrics and garments.

However pure liquid carbon dioxide and fabrics are both poor conductors of electricity. The motion of the solvent and fabrics when cleaned using the system of copending U.S. Pat. No. 5,467,492, and any other system that promotes friction, results in the build-up of static charge that is not readily dissipated. Static charge on fabrics tend to attract soil and lint that has initially been dislodged by the very motion that generates the static. This results in soil redeposition (graying) and an unsightly fabric appearance.

Accordingly, it is an objective of the present invention to provide for an improved liquid carbon dioxide dry cleaning system that employs a static dissipating fluid and optional deodorant. It is a further objective of the present invention to provide for an improved liquid carbon dioxide dry cleaning fluid containing static dissipating and deodorant components.

SUMMARY OF THE INVENTION

To meet the above and other objectives, the present invention adds an antistatic agent to a liquid carbon based cleaning fluid or solvent that is used in a high shear or static generating environment. Such an environment includes, but is not limited to, an optical parts degreasing process, where liquid carbon dioxide fluid jets are used as a means of dislodging particulate soil on the parts. The present invention is particularly well suited for use in a garment dry cleaning system. Depending on the cleaning application, the antistatic agent may be present throughout the entire cleansing cycle, or only during one segment of it, such as a washing segment, for example.

In one specific embodiment of the present invention that has been reduced to practice, an antistatic agent is added to a liquid carbon based cleaning fluid or solvent used in a garment dry cleaning system that operates in a high shear environment, to dissipate the static charge generated by friction. The presence of small concentrations of antistatic agents in the liquid carbon dioxide cleaning fluid (typically less than 1 percent) prevents a large build-up of static electricity. This is achieved by transferring the static charge through the dry cleaning fluid to the metal shell of the garment containing basket and its grounding wire. The reduction in static build-up leads to lower suspended (insoluble) soil redeposition onto the garments. The present invention also provides for the addition of fragrances and/or deodorizers to the cleaning fluid.

The present invention thus reduces the static charge generated during a liquid carbon dioxide cleaning process. This static dissipation prevents the redeposition of the dislodged particles, such as soil or lint, for example, back onto cleaned garments or components. The addition of odorizers or deodorizers improves the "olfactory" output of the cleaning process, particularly in the garment cleaning application. The liquid carbon dioxide containing antistatic, odorizing, or deodorizing components provides an improved liquid carbon dioxide dry cleaning fluid.

BRIEF DESCRIPTION OF THE DRAWINGS

The various features and advantages of the present invention may be more readily understood with reference to the following detailed description taken in conjunction with the accompanying drawing which illustrates a liquid carbon dioxide dry cleaning system employing an improved dry cleaning fluid in accordance with the principles of the present invention.

DETAILED DESCRIPTION

Figure 1:
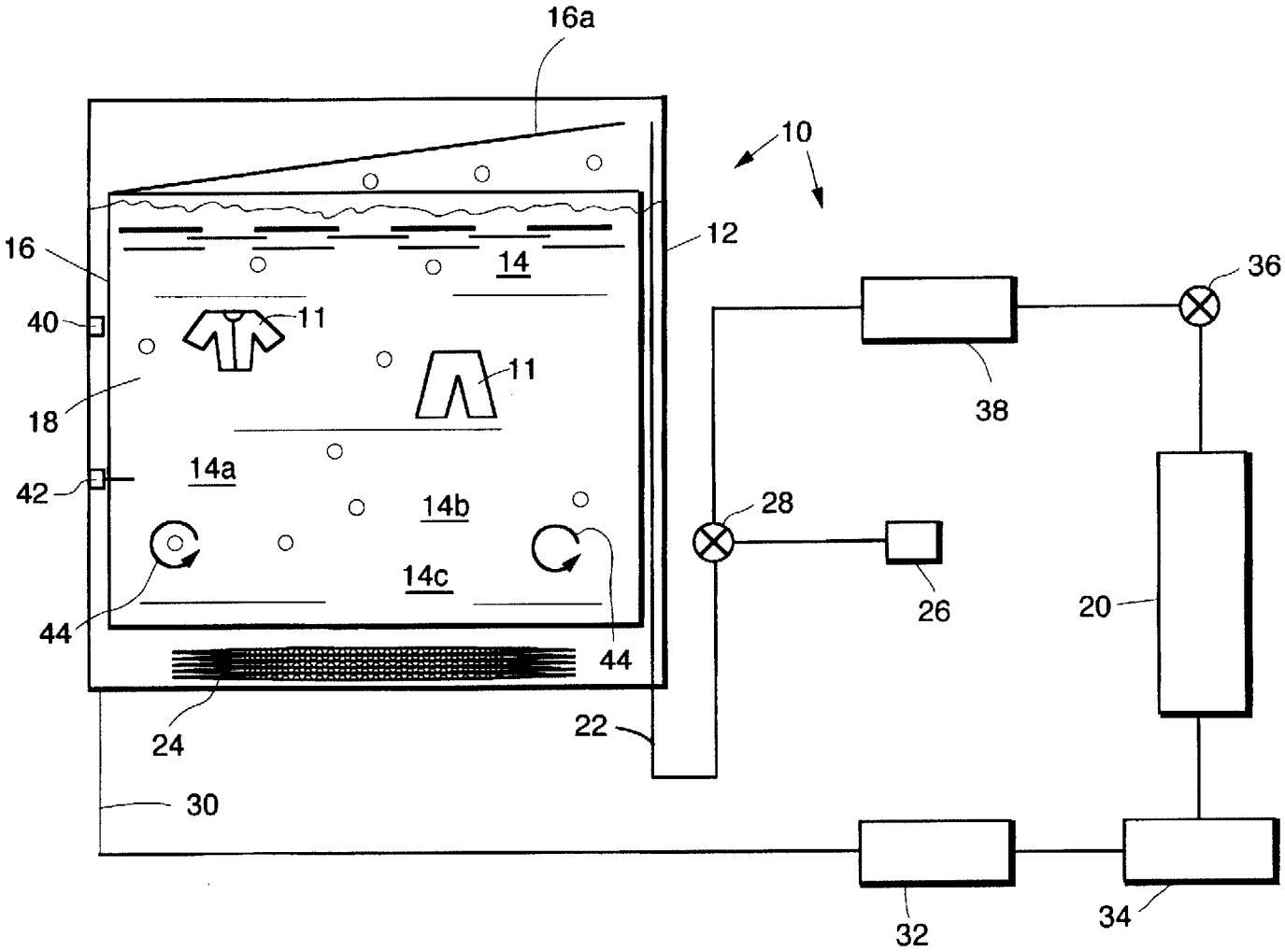

Referring to the drawing FIGURE, it illustrates a reduced to practice embodiment of an exemplary liquid carbon dioxide dry cleaning system 10 employing an improved dry cleaning fluid 14 in accordance with the principles of the present invention. The exemplary liquid carbon dioxide dry cleaning system 10 comprises a pressurizable vessel 12 into which garments 11 are loaded that are to be cleaned. A conductive perforated cleaning drum 16 having a lid **16*a* is disposed within the pressurizable vessel 12. The cleaning drum 16 is also electrically grounded. Liquid carbon dioxide 18 is pumped into the pressurizable vessel 12 from a pressurized storage tank 20**.

Liquid carbon dioxide 18 is supplied to the vessel 12 from the pressurized storage tank 20 through an inlet 22. A pump 36 is used to transfer the liquid carbon dioxide 18 continuously from the storage tank 20 into the vessel 12 and back into the storage tank 20. A preheater 38 is disposed between the pump 36 and the vessel 12 and aids in controlling the temperature of the circulating liquid carbon dioxide 18. Pressure control means, such as a pressure gauge 40, and temperature control means, such as a thermocouple 42, are disposed in or coupled to the vessel 12 and are used to control the pressure and temperature, respectively, of the liquid carbon dioxide 18.

The vessel 12 includes a heater 24 to provide for temperature control of the fluid 14 to maintain a "boiling" liquid $CO_2$ phase during garment cleaning. Also, the vessel 12 has an agitation means which is generally depicted by arrows 44, and that is used to agitate the garments 11 during cleaning. A valve 28 is used to introduce a cleaning additive or cleaning enhancer 26 into the vessel 12 by way of the inlet line 22.

Typical cleaning additives or enhancers 26 useful in the practice of the present invention include, but are not limited to, anionic and non-ionic surfactants, such as alkyl benzene sulfonates, alkyl benzene sulfates, olefin sulfonates, olefin sulfates, ethoxylated alkyl phenols, and ethoxylated fatty alcohols. Water is advantageously employed as the solvent.

Contaminated surfactant and liquid carbon dioxide 18 are removed from the vessel 12 through an outlet 30 and are decompressed in a separator 32 equipped with a filtration system to remove the insoluble particulates. Upon decompression, the carbon dioxide loses its solvating characteristics and the particulates and any cleaning enhancers drop out into the separator 32 in a concentrated form, while the clean gaseous carbon dioxide is returned to the storage tank 20 via a condenser 34, where it is reliquified.

During operation, the vessel 12 is loaded with the garments and/or fabrics 11 and then charged with liquid carbon dioxide 18 and a cleaning enhancer 26 through the inlet 22. Once the vessel 12 is charged with liquid carbon dioxide 18, the garments 11 are agitated to clean them, which generally speeds up cleaning, aids in removal of insoluble particulates, and reduces the possibility of redeposition of contaminants.

However, as was discussed above in the Background section, agitation alone does not completely clean the garments 11 due to the presence of static charge. Therefore, to improve the performance of the liquid carbon dioxide dry cleaning system 10, one embodiment of the present invention adds an antistatic agent **14*a* to the dry cleaning fluid 14 to dissipate the static charge generated by friction. Another embodiment of the present invention also adds an odorizing agent 14*b* (fragrance 14*b*) and/or a deodorizing agent 14*c* to the cleaning fluid 14. The presence of small concentrations of the antistatic agent 14*a* in the cleaning fluid 14 (typically less than 1 percent) prevents a large build-up of static electricity on the garments 11. The static charge is transferred through the dry cleaning fluid 14 to the cleaning drum 16 to ground. The reduction in static build-up leads to lower suspended (insoluble) soil redeposition onto the garments 11**.

Typical antistatic agents **14*a* include, but are not limited to surfactants, such as alcohol ethoxylates, alkylene glycols, and glycol esthers, for example. Typical odorizing and/or deodorizing agents 14*b* or fragrances 14*b*** include scents or fragrances comprised of but not limited to natural or synthetic essential oils and related produces, for example.

The present invention thus reduces the static charge generated during liquid carbon dioxide dry cleaning of garments 11. The static dissipation prevents redeposition of dislodged soil and lint back onto the cleaned garments 11. Furthermore, the addition of the odorizing or deodorizing agents **14*b*, 14*c* improves the "olfactory" output of the cleaning process. The liquid carbon dioxide cleaning fluid 14 containing antistatic, odorizing, or deodorizing agents 14*a*, 14*b*, 14*c* thus provides for an improved liquid carbon dioxide dry cleaning fluid 14**.

In order to test out the concepts of the present invention, a number of fabric loads were cleaned using the liquid carbon dioxide dry cleaning system 10 with and without the improved cleaning fluid of the present invention. Using the prior liquid carbon dioxide dry cleaning fluid, although the load and comparative standards appeared clean, there was static build-up on the fabric loads, and more so on synthetic or low regain moisture garments. Also, a thin layer of insoluble particulate soil was observed on the wall of the cleaning chamber or basket. When an antistatic compound treated and impregnated "dryer sheet" was added to the garment load, the conditions noted above were no longer noticeable. The same "dryer sheet" also contained an odorant that caused the garment load to have a pleasant odor. This was also noted with subsequent garment loads. These results indicate that the antistatic agent and fragrance effectively charged the liquid carbon dioxide solvent cleaning fluid, forming an improved solvent cleaning fluid.

Thus, the present invention adds an antistatic agent to a liquid carbon based cleaning fluid or solvent that is used in a high shear or static generating environment. In addition to the above described garment cleaning application, the present invention may be used for general purpose cleaning of components in a static generating environment. For example, the present invention may be used in an optical or mechanical parts degreasing process where static is encountered, and wherein liquid carbon dioxide fluid jets are used as a means of dislodging particulate soil on the parts. Depending on the cleaning application, the antistatic agent may be present throughout the entire cleansing cycle, or only during one segment of it.

Thus, a liquid carbon dioxide dry cleaning system employing a static dissipating and deodorizing cleaning fluid has been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A liquid carbon dioxide dry cleaning system comprising:

a pressurizable vessel into which garments are loaded that are to be cleaned;

a conductive, perforated and grounded cleaning drum disposed within the pressurizable vessel;

liquid carbon dioxide dry cleaning fluid disposed in the pressurizable vessel;

an antistatic agent disposed in the liquid carbon dioxide cleaning fluid for dissipating static charge on the garments generated by friction during cleaning of the garments; and agitation means for agitating the garments during cleaning;

and wherein static charge present on the garments is transferred through the liquid carbon dioxide dry cleaning fluid to the cleaning drum to ground, which minimizes static charge on the garments and redeposition of suspended soil onto the garments caused by such static charge.

2. The dry cleaning system of claim 1 further comprising an odorizing agent disposed in the liquid carbon dioxide dry cleaning fluid.

3. The dry cleaning system of claim 1 further comprising a deodorizing agent disposed in the liquid carbon dioxide cleaning fluid.

4. The dry cleaning system of claim 2 further comprising a deodorizing agent disposed in the liquid carbon dioxide cleaning fluid.

5. The dry cleaning system of claim 1 wherein the antistatic agent has a concentration of less than 1 percent.

6. The dry cleaning system of claim 1 wherein the antistatic agent comprises surfactant.

7. The dry cleaning system of claim 1 wherein the antistatic agent is a surfactant selected from the group of alcohol ethoxylates, alkylene glycols, and glycol esthers.

8. The dry cleaning system of claim 1 wherein the odorizing agent is selected from the group of natural and synthetic essential oils.

9. The dry cleaning system of claim 1 wherein the deodorizing agent selected from the group of natural and synthetic essential oils.

10. The dry cleaning system of claim 1 further comprising a cleaning enhancer 26 disposed in the pressurizable vessel.

* * * * *